US005588318A

United States Patent [19]

Osborne

[11] Patent Number: 5,588,318

[45] **Date of Patent: *Dec. 31, 1996**

[54] DOOR LOCK

[75] Inventor: Shelby M. Osborne, Lexington, Ky.

[73] Assignee: FireKing International, Inc., Lexington, Ky.

[ * ] Notice: The portion of the term of this patent subsequent to Dec. 19, 2012, has been disclaimed.

[21] Appl. No.: 917,592

[22] Filed: Jul. 23, 1992

[51] Int. Cl.[6] ..... E05B 17/00

[52] U.S. Cl. ..... 70/469; 292/144; 292/174; 292/150; 70/118; 70/150

[58] Field of Search ..... 292/144, 37, 40, 292/165, 170, 150, 174; 70/150, 469, 210, 104, 103, 113, 118

[56] References Cited

U.S. PATENT DOCUMENTS

| | | | |
|---|---|---|---|
| 1,833,572 | 11/1931 | Hardesty | 70/283 |
| 2,765,648 | 10/1956 | Hatcher | 292/144 |
| 3,143,873 | 8/1964 | Hillgren | 292/150 |
| 3,371,628 | 3/1968 | McClellan | 109/59 R |
| 4,148,092 | 4/1979 | Martin | 70/278 |
| 4,288,944 | 9/1981 | Donovan | 292/40 |
| 4,679,415 | 7/1987 | Spratt | 70/188 |
| 4,784,415 | 11/1988 | Malaval | 292/144 |
| 4,993,757 | 2/1991 | Corzine | 292/144 |
| 5,076,621 | 12/1991 | Taylor et al. | 292/189 |
| 5,134,870 | 8/1992 | Uyeda et al. | 70/279 |
| 5,245,846 | 9/1993 | James | 109/59 R |
| 5,249,831 | 10/1993 | Maniaci | 109/59 R |

FOREIGN PATENT DOCUMENTS

| | | | |
|---|---|---|---|
| 10446 | 1/1903 | Austria | 292/144 |
| 583103 | 6/1924 | France | 292/144 |
| 2534392 | 4/1984 | France | 292/144 |
| 41755 | 5/1909 | Germany | 70/1.5 |
| 2504774 | 8/1975 | Germany | 292/144 |
| 3926132 | 2/1991 | Germany | 709/59 R |
| 15790 | of 1915 | United Kingdom | 292/144 |

*Primary Examiner*—Darnell M. Boucher
*Attorney, Agent, or Firm*—Brooks & Kushman P.C.

[57] ABSTRACT

A door lock, particularly well suited for use with a safe which includes a movable door latch mechanism having a lock bolt abutment surface. The door lock comprises a casing having a locking bolt-receiving aperture in one of its walls. The casing is to be mounted to the door, for example, on the inside surface of the door with the bolt-receiving aperture adjacent the bolt-abutment surface of the door latch mechanism. A locking bolt is longitudinally slidably mounted with the casing for movement at an acute angle relative to the bolt abutment surface of the door latch mechanism between a locked position projecting through the aperture in the casing and into abutment with the abutment surface of the door latch mechanism and an unlocked position out of abutment with the abutment surface of the door latch mechanism and retracted into the casing.

7 Claims, 3 Drawing Sheets

DOOR LOCK

BACKGROUND OF THE INVENTION

The present invention relates to door locks, and more particularly to locks for safes and the like having a movable bolt for engagement with a door latch mechanism to lock the door, and for disengagement from the door latch mechanism to unlock the door.

Bolt-type door locks are, per se, known. The following U.S. Patents are illustrative of such heretofore known locks.

U.S. Pat. No. 4,887,445 issued to Scott M. Beatty on Dec. 19, 1989 shows a lock for a safe door. The lock includes a bolt slidably mounted in a guide block of the lock for movement into and out of a bolt-receiving opening in the adjacent door jamb. The bolt is movable in a direction perpendicular to the adjacent door jamb into the bolt-receiving opening to lock the door and out of the bolt-receiving opening to unlock the door. The bolt is moved by an electric motor into and out of the locked position through a rocker arm, drive cam and drive panel arrangement which provides a slip clutch protecting the lock mechanism from damage in the event the bolt becomes jammed in the bolt-receiving opening in the door jamb.

U.S. Pat. No. 4,563,886 issued to Karl Kletzmaier et al on Jan. 14, 1986 shows a lock for securing a safe door which includes a bolt slidably mounted for movement into and out of a bolt-receiving opening in the adjacent door jamb. The bolt is movable in a direction perpendicular to the adjacent door jamb into the bolt-receiving opening to lock the door, and out of the bolt-receiving opening to unlock the door. The bolt is moved by a handle device into and out of the bolt-receiving opening in the adjacent door jamb.

U.S. Pat. No. 4,904,984 issued to K. W. Gartner et al on Feb. 27, 1990 shows a lock for a safe door which includes a locking bolt which is rotatably mounted in a housing for movement into and out of a bolt-receiving opening in an adjacent door jamb or the like. The bolt is movable in a direction perpendicular to the door jamb. The bolt is moved into and out of the bolt-receiving opening by a bolt lever pivotably connected at one end to the bolt and engaged at the other end to a cam wheel such that when the cam wheel is rotated the lever push or pulls the bolt lever thereby moving the bolt. A solenoid located in the housing has its operating rod positioned to interfere with the bolt lever when extended to prevent movement of the bolt lever, and therefore to prevent movement of the bolt, and when the operating rod is retracted, will allow movement of the bolt lever, and therefore will allow movement of the bolt.

U.S. Pat. No. 4,926,664 issued to K. W. Gartner et al on May 22, 1990 shows a self-locking electronic lock for a safe door. The electronic lock is used with a door locking bolt works which includes a vertical link with door bolts attached thereto. The vertical link is connected to a handle through gears to move the bolt link in an arcuate path moving the door bolts forward and into openings in the adjacent door jamb to lock the door and away and out of the openings in the adjacent door jamb to unlock the door. The bolt link is formed with a square notch in one longitudinal side and the electronic lock is positioned adjacent the notch in the bolt link. The electronic lock has a lock bolt slidably mounting in the electronic lock housing, and is located with the lock bolt in alignment with the square notch in the bolt link for movement perpendicular to the bolt link into and out of the square notch in the bolt link. The electronic lock includes a small electric motor having a threaded output shaft. The bolt is formed with a threaded bore receiving the threaded electric motor output shaft. The motor is activated to rotate in one direction to retract the lock bolt to move the lock bolt from the square notch in the link, and activated to rotate in the opposite direction to move the lock bolt back into the square notch in the link.

The heretofore known locks are necessarily such a construction which requires them to be asymmetrical and, therefore, these prior-art locks must be manufactured in left and right verions.

The above-discussed safe door locks are relatively complicated and, therefore, expensive to manufacture.

SUMMARY OF THE INVENTION

The present invention recognizes the drawbacks of the heretofore known safe door lock mechanisms and overcomes these drawbacks.

The present invention also provides a door lock mechanism which is relatively straightforward in construction and, therefore, less expensive to manufacture.

The present invention provides a door lock with a minimum number of components which is easily and quickly assembled even by an unskilled worker.

The present invention provides a door lock which is symmetrical and, therefore, can be used in left-hand and right-hand installation thereby saving manufacturing costs because left and right-hand tooling is not required and also saving inventory costs because left-hand and right-hand locks do not have to be stocked.

The present invention provides a lock with a lock bolt which is moved to the retracted unlocked position by the coaction therewith of door latch mechanism and, therefore, does not require internal actuators to move the lock bolt to the retracted unlocked position.

More particularly, the present invention provides a door lock, particularly well suited for safes and the like for selectively engaging a bolt abutment surface of a door latch mechanism to lock the door. The lock comprises a casing to be attached to the door adjacent the door latch mechanism. The casing has a bolt-receiving aperture with a bolt longitudinally slidably mounted within the casing for movement at an acute angle relative to the bolt abutment surface of the door latch mechanism. The bolt is movable between a locked position whereat one end of the bolt projects through the bolt-receiving aperture and into abutting relationship with the bolt-abutment surface of the door latch mechanism to prevent movement of the door latch mechanism, and an unlocked position retracted within the casing out of abutting relationship with the bolt-abutment surface of the door latch mechanism.

BRIEF DESCRIPTION OF THE DRAWINGS

A better understanding of the invention will be had upon reference to the following description in conjunction with the accompanying drawings, wherein.

DETAILED DESCRIPTION OF THE PREFERRED EMBODIMENT

Figure 1:
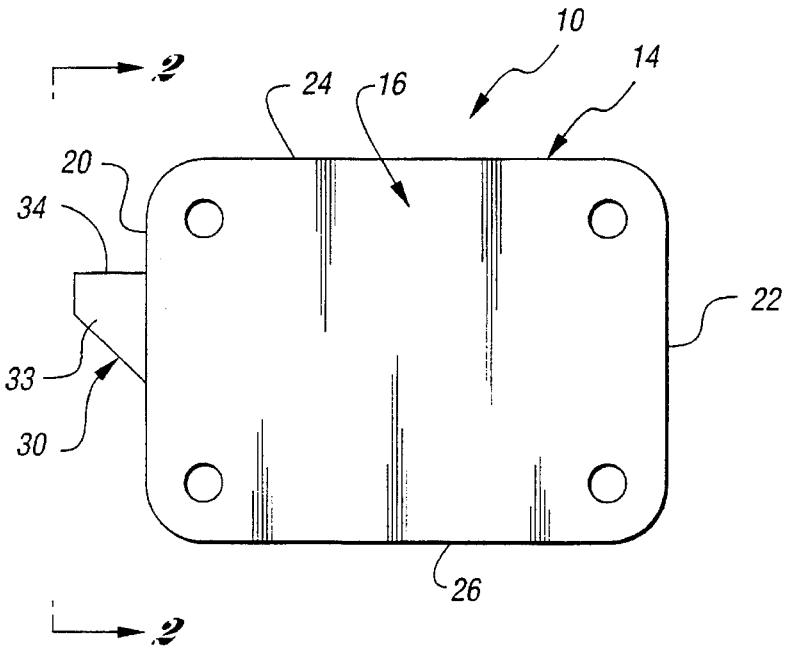
FIG. 1 is a side view of the lock of the present invention.
Figure 2:
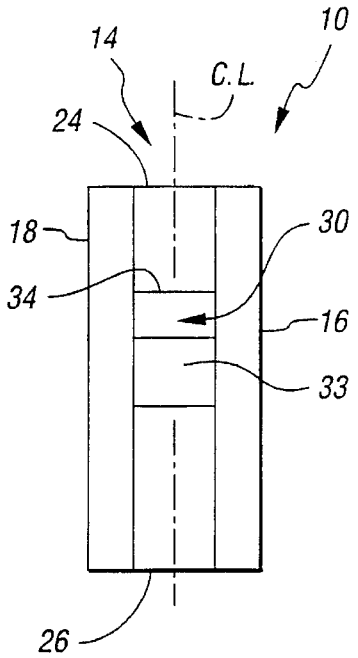
FIG. 2 is a front end view as seen in the direction of arrows 2—2 in FIG. 1.

With reference to FIGS. 1–4 and 8–9, there is shown a lock device, generally denoted as the numeral 10, particularly well suited for use with a safe 60.

With reference to FIGS. 1–4, the lock device 10 includes a generally rectangular case 14 having a first side wall 16, a second side wall 18 parallel to and spaced from the first side wall 16, a front end wall 20 perpendicular to and extending between the first and second side walls, a back wall 22 spaced from and parallel to the front end wall 20 extending between the first and second side walls, a top wall 24 mutually perpendicular to the side walls 16, 18 and end walls 20, 22, and a bottom wall 26 spaced from and parallel to the top wall 24. As shown, the end walls 20 and 22 are integral with the top wall 24 and bottom wall 26 which mutually cooperate to define a housing 28. The side walls 16 and 18 are removably secured in position to the housing 28 by, for example, removable fasteners such as bolts.

Figure 3:
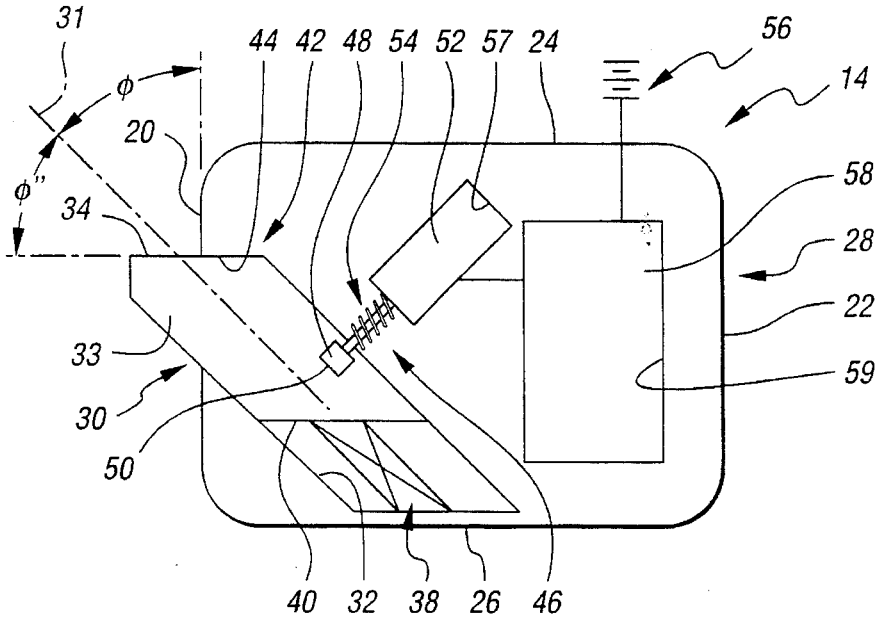
FIG. 3 is a side view of the lock of FIG. 1 with the side wall removed to show internal details and with a bolt component in the extended or locking position.
Figure 4:
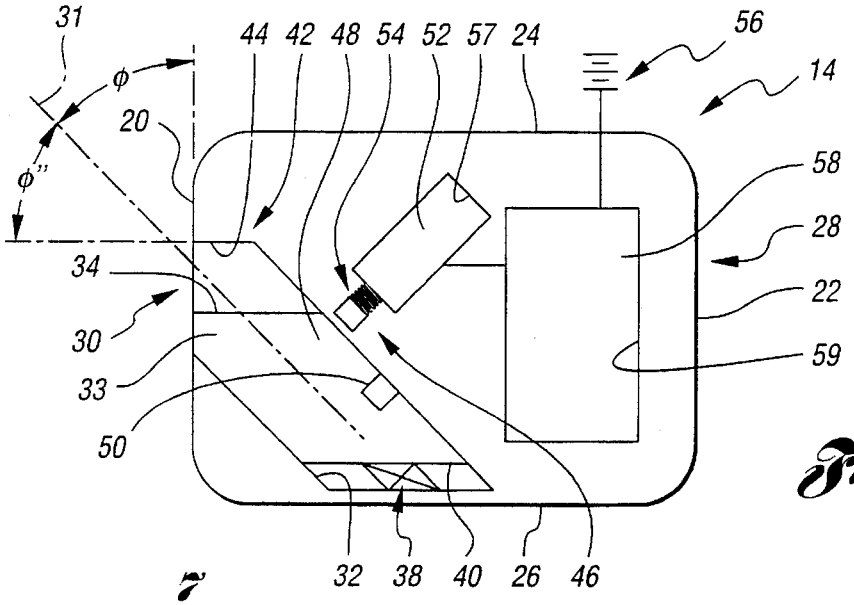
FIG. 4 is a side view similar to FIG. 3 with the bolt component in the retracted or unlocking position.
Figure 5:
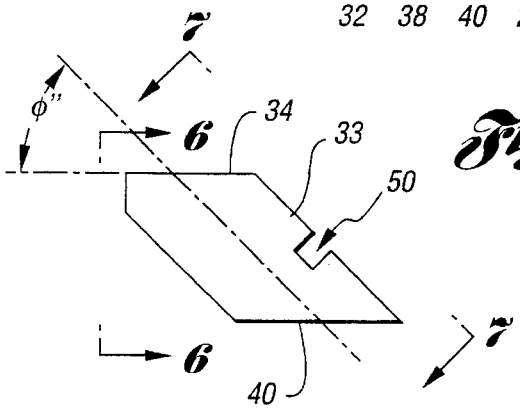
FIG. 5 is a side view of a bolt component of the lock device of the present invention.
Figure 6:
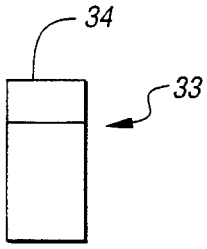
FIG. 6 is a front view of the bolt as seen in the direction of arrows 6—6 in FIG. 5.
Figure 7:
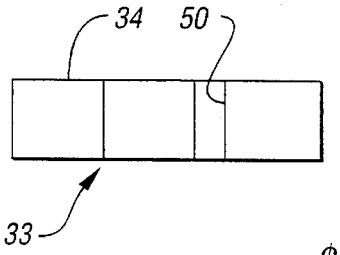
FIG. 7 is a top view of the bolt as seen in the direction of arrows 7—7 in FIG. 5.

With reference to FIGS. 3–7, the front end wall 20 is formed with a bolt-receiving aperture 30 laterally centered between the side walls 16 and 18. Preferably, the bolt-receiving aperture 30 extends completely or laterally of the front end wall 20 of the housing 28. Therefore, the lock device 10 is symmetrical about a vertical centerline C.L. (see FIG. 2) so that the same lock device 10 can be utilized in an installation as both a right-hand and left-hand lock. The housing 28 is formed with a blind-ended bolt-receiving channel 32 in open communication at one end with the bolt-receiving aperture 30 with its longitudinal axis 31 and extending from the bolt-receiving aperture 32 at an acute included angle to the front end wall 20 into the interior of the housing 28. Preferably, the acute included angle is from about 40° to about 50°. As shown, the housing bottom wall 26 forms the blind end of the channel 32. An elongated lock bolt 33 is located in the elongated channel 32 with the longitudinal axis of the bolt 33 coincidental with the longitudinal axis 31 of the bolt-receiving channel 30 for sliding movement therein between a locking position (see FIG. 3) whereat one end of the lock bolt 33 projects outwardly through the aperture 30, and an unlocking position (see FIG. 4) retracted within the housing 28. The end of the lock bolt 33 adjacent the bolt-receiving aperture 30 in the front end wall 20 has a working or abutment face 34 which is at an acute included angle relative to the longitudinal axis (shown in phantom lines in FIG. 5) of the bolt lock 33. The acute included angle of the abutment face 34 relative to the longitudinal axis of the bolt 33 is equal to the acute included angle of the longitudinal axis of the channel 32 relative to the front end wall 20 of the housing 28 (preferably from about 40° to about 50°), and, therefore, the abutment face 34 relative of the bolt 33 is perpendicular to the front end wall 20 of the housing 28. The bolt 33 is resiliently biased to slide in the channel 32 toward bolt-receiving aperture 30 in the housing front end wall 20 so the working or abutment end 34 projects outwardly of the housing 28 through the bolt-receiving aperture 30. Toward this objective, resilient biasing means 38, such as, for example, a spring is located in the housing between the end 40 of the bolt opposite the end thereof having the abutment face 34 and the housing bottom wall 26 forming the blind end of the channel 32. The housing 28 is formed with a first bolt stop means 42 which cooperates with the bolt 33 to limit the sliding movement of the bolt 33 (due to the force generated by the biasing means 38) outwardly of the housing 28 through the bolt-receiving aperture 30 so that the abutment face 34 of the bolt 33 protrudes from the aperture 30 a predetermined distance. As shown in FIGS. 3 and 4, the first bolt stop means 42 consists of a shelf 44 at the housing front end wall 20 in-line with one side of the bolt-receiving aperture 30 and extending perpendicularly inwardly of the housing 28 from the housing front end wall 20 to one longitudinal side of the channel 33. The shelf 44 is an acute included angle relative to the longitudinal axis of the channel 30, and this acute angle is equal to the acute included angle of the abutment face 34 of the bolt 33 relative to the longitudinal axis of the bolt 33 (preferably from about 40° to about 50°). Therefore, when the bolt 33 is moved through the aperture 30 under the influence of the biasing means 38, the abutment face 34 of the bolt 33 contacts the stop shelf 44 preventing further movement of the bolt 33 so that only the predetermined length of the bolt 33 projects outwardly through the aperture 30.

With continued reference to FIGS. 3, 4, 5, and 7, the lock device 10 also includes second stop means 46 to selectivley prevent movement of the bolt 33 inwardly into the housing 28 from the locking or projecting position (see FIG. 3) to the unlocking or retracted position (see FIG. 4). As shown, the second stop means 46 includes a stop pin 48 movably mounted in the housing 28 adjacent the bolt 33 for selected movement toward and away from the elongated bolt 33, and a stop pin receiving notch 50 formed in one longitudinal side of the bolt 33 to receive the stop pin 48 only when the bolt 33 is in the locking position (see FIG. 3). Therefore, when the bolt 33 is in the locking position, the stop pin 48 is received in the stop pin-receiving notch 50 to prevent longitudinal movement of the bolt 33 in the channel 32, and when the stop pin 48 is moved out of the stop pin-receiving notch 50 the bolt 33 is free to move longitudinally of the channel 32 against the biasing force of the biasing means 38 from the locking position (see FIG. 3) to the unlocking position (see FIG. 4). The stop pin 48 is operatively connected to linear actuator means 52, such as a solenoid, located in the housing 28. The stop pin 48 is biased in the extended position whereat the stop pin 48 is received in the stop pin-receiving notch 50 by biasing means 54, such as a coil spring captured between the solenoid 52 and distal end of the stop pin 48. The solenoid 52 pulls or retracts the stop pin 48 out of the stop pin-receiving notch 50 against the biasing force of the spring 38 when it is energized, and allows the biasing force of the biasing coil spring 54 to move the stop pin 48 into the stop pin-receiving notch 50 when it is de-energized.

The solenoid 52 is operatively connected to a power source 56, such as a battery, through electrical signal coded output means 58 such as, for example, an electronic lock device. Examples of such electrical signal-coded output means are shown in U.S. Pat. No. 4,745,784; U.S. Pat. No. 4,148,092; U.S. Pat. No. 4,558,175; and U.S. Pat. No. 4,207,555. The power source 56 and electrical signal-coded output means 58 do not, per se, form part of the compact lock device 10 of the present invention, and, therefore, for the sake of brevity, they will not be further discussed. However, the novel positioning of the lock bolt 33 at an acute included relative to the front end wall 20 of the housing 28 provides such efficient utilization of the interior space of the housing 28 as to allow the solenoid 52, bolt 33, and signal coded output means 58 to be located in the housing 28. In use, when a correct access code is imputed into the signal coded output means 58, the solenoid 52 is energized to pull the stop pin 48 out of the drop pin-receiving notch 50 of the bolt 33.

Figure 8:
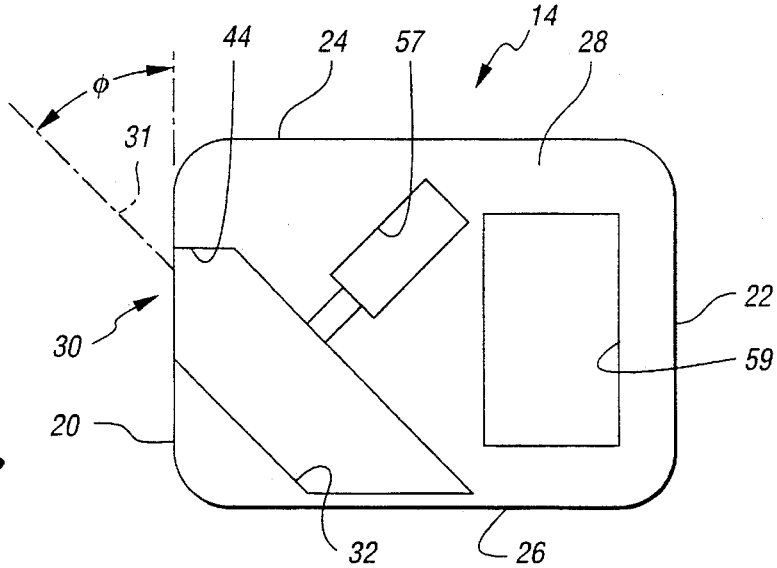
FIG. 8 is a side view of a housing component of the lock of FIGS. 1–3.

Now with reference to FIG. 8, in addition to the bolt-receiving channel 32, the housing 28 is also formed with a solenoid-receiving pocket 57 sized and configured for receiving and properly locating the solenoid 52 closely adjacent the bolt-receiving channel 32, and an electrical signal output device receiving pocket 59 sized and configured for receiving and locating the electrical signal output device 58 closely adjacent the solenoid-receiving pocket 57 and bolt-receiving channel 32. Toward this objective, the housing 28 can be cast from a suitable material with integral partitions defining the bolt-receiving channel 32, solenoid-receiving pocket 57, and electrical signal output device pocket 59.

The construction of the housing 28 and the four internal components (lock bolt 33, solenoid 52, biasing means 54, and electrical signal output device 56) provide for easy and rapid assembly of the lock device 10 by even an unskilled worker.

Figure 9:
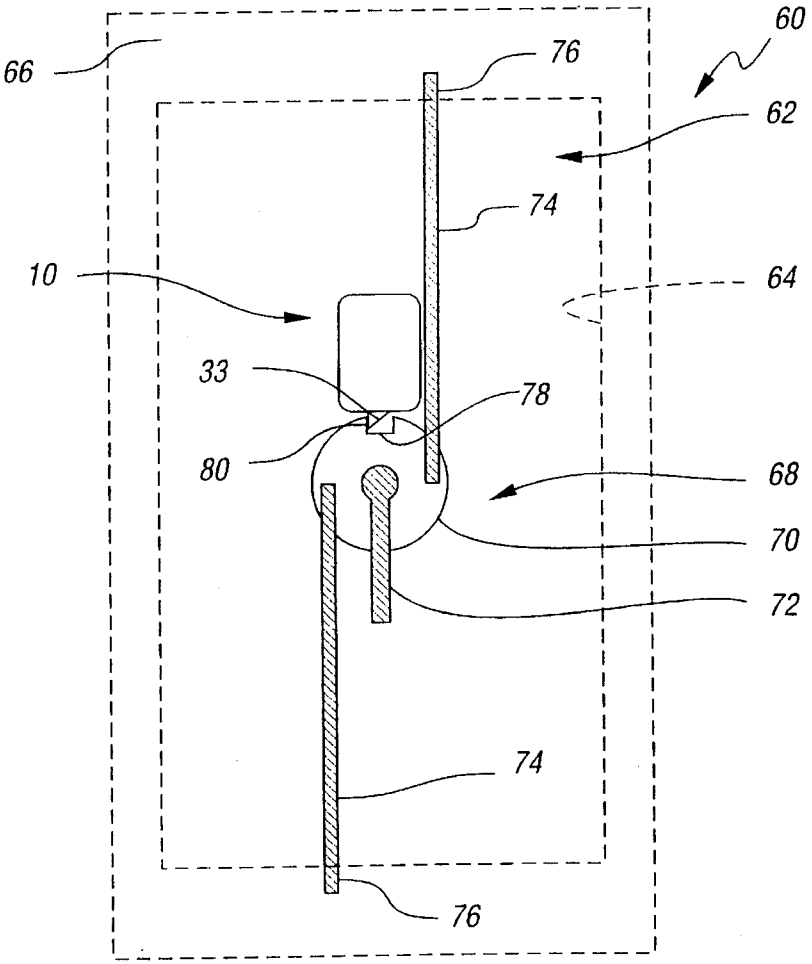
FIG. 9 is a schematic of one typical installation of the lock of the present invention in a safe; and, FIG. 10 is a schematic of another typical installation of the lock of the present invention in a safe.

Now with reference to FIG. 9, there is shown one known type of safe 60 of conventional design (shown in phantom lines) which includes a door 62 for closing the opening 64 in the safe body or box 66. The safe 60 includes a bolt works or door-latching mechanism, generally denoted as the numeral 68. The typical bolt works 68 includes a lock bolt engagement mechanism such as a latch cam 70 located inside the safe door 62 and connected to a handle 72 located on the exterior side of the door 62. The bolt works 68 also includes a plurality of door-latching rods 74 also located inside the safe door 62 for movement into and out of rod-receiving cavities 76 formed in the jamb of the door opening 64 adjacent the distal ends of the door-latching rods 74. The proximal ends of each door-latching rod 74 inside the door are pivotably connected to the latch cam 70 so that as the handle 72 is rotated the cam 70 is rotated moving the latching rods 74 either into or out of the rod-receiving cavities 76 depending upon the direction of rotation of the handle 72 and, therefore, the direction of rotation of the latch cam 70. The lock bolt engagement mechanism or latch cam 70 has a lock bolt-receiving notch 78 with a lock-bolt abutment surface 80. The lock device 10 of the present invention is shown as being installed in a right-hand orientation positioned adjacent the lock bolt-engagement mechanism 70 with the bolt-receiving aperture 30 in the front end wall 20 in facing alignment with the lock bolt-receiving notch 78 when the bolt works 68 is in the door latch position with the door-latching rods 74 received in the rod-receiving cavities 76 thereby latching the door 62. With the bolt works 68 in this latched position, the solenoid 52 of the door lock device 10 is de-energized and the lock bolt 33 is positioned in the locking position (see FIG. 3) under the influence of the biasing force of the spring 38 projecting through the bolt-receiving aperture 30 of the lock device 10 into the lock bolt-receiving notch 78 of the lock bolt-engagement mechanism 70 with the abutment face 34 of the bolt 33 abutting the lock-bolt abutment surface 80. If a person attempts to turn the handle 72 to move the bolt works 68 from the door latch position without first activating the lock device 10 to engage the solenoid 52, the abutting relationship of the lock bolt-abutment surface 80 of the bolt-receiving notch 78 in the lock bolt-engagement mechanism 70 abutting the abutment face 34 of the lock bolt 33 prevents movement of the bolt works 68 so that the door-latching rods 74 cannot be removed or retracted from the rod-receiving cavities 76. The lock bolt 33 cannot move in the channel 32 from the locking position (see FIG. 3) to the unlocking position (see FIG. 4) because the stop pin 48 is positioned in the stop pin-receiving notch 50 of the lock bolt 33. In order to move the bolt works 68 from the door latched position to a door unlatched position whereat the door-latching rods 74 are removed from the rod-receiving cavities 76, the lock device 10 must be activated to energize the solenoid 52. This is accomplished by, for example, inputing a correct code into the coded electrical signal output device 58 which then energizes the solenoid 52. The energized solenoid 52 pulls the stop pin 48 out of the stop pin-receiving notch 50 of the lock bolt 33 which frees the lock bolt 33 for sliding movement in the channel 32 against the biasing force of the spring 38. Then, when the bolt works 68 is moved by the handle 72 from the door latched position to the door unlatched position, the bolt lock abutment surface 80 of the bolt-receiving notch 78 in the lock bolt engagement mechanism 70 is forced or pushes against the abutment face 34 of the lock bolt 33. The bolt abutment face 34 functions in the manner of a cam surface providing a force component longitudinally of the lock bolt 33 pushing or forcing the lock bolt 33 into the housing 24 to the retracted position (see FIG. 4) against the biasing force of the spring 38 and out of contact with the bolt lock abutment surface 80 of the bolt-receiving notch 78 thereby allowing the latch cam 70 of the bolt works 68 to move from door latched position to the door unlatched position pulling the door latching rods 74 out of the rod-receiving cavities 76 unlatching the safe door 62.

Figure 10:
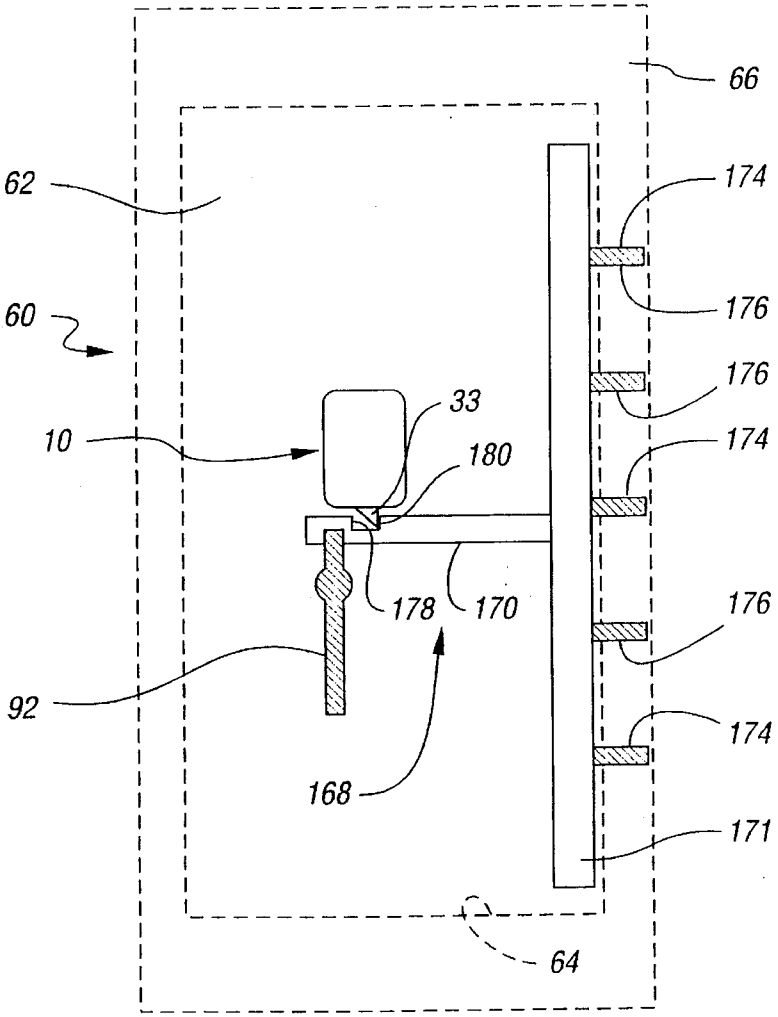

Now with reference to FIG. 10, there is shown another type of known safe 60 of conventional design (shown in phantom lines) which includes a door 62 for closing the opening 64 in the safe body or box 66. The safe 60 includes a bolt works or door-latching mechanism, generally denoted as the numeral 168. The bolt works 168 includes a lock bolt engagement mechanism such as a horizontal bar 170 located inside the safe door 62 and pivotally connected at one end to a handle 72 located on the exterior side of the door 62 and with a vertical bar 171 attached to the other end of the horizontal bar 170. A plurality of door-latching rods 174 are attached at spaced intervals to the vertical bar 171 for movement into and out of rod-receiving cavities 176 formed in the jamb of the door opening 64 adjacent the distal ends of the door-latching rods 174. As the handle 72 is rotated the horizontal bar 170 moves longitudinally moving the vertical bar 171, and the latching rods 174 either into or out of the rod-receiving cavities 176 depending upon the direction of rotation of the handle 72 and, therefore, the direction of movement of the horizontal bar 170. The lock bolt engagement mechanism or horizontal 170 has a lock bolt-receiving notch 178 with a lock-bolt abutment surface 180. The lock device 10 of the present invention is shown as being installed in a left-hand orientation positioned adjacent the lock bolt-engagement mechanism 170 with the bolt-receiving aperture 30 in the front end wall 20 in facing alignment with the lock bolt-receiving notch 178 when the bolt works 168 is in the door latch position with the door-latching rods 174 received in the rod-receiving cavities 176 thereby latching the door 62. With the bolt works 168 in this latched position, the solenoid 52 of the door lock device 10 is de-energized and the lock bolt 33 is positioned in the locking position (see FIG. 3) under the influence of the biasing force of the spring 38 projecting through the bolt-receiving aperture 30 of the lock device 10 into the lock bolt-receiving notch 178 of the lock bolt-engagement mechanism 170 with the abutment face 34 of the bolt 33 abutting the lock bolt abutment surface 180. If a person attempts to turn the handle 72 to move the bolt works 168 from the door latch position without first activating the lock device 10 to energize the solenoid 52, the lock bolt-abutment surface 180 of the bolt-receiving notch 178 in the lock bolt-engagement mechanism 170 abutting the abutment face 34 of the lock bolt 33 prevents movement of the bolt works 168 so that the door-latching rods 174 cannot be removed or retracted from the rod-receiving cavities 176. The lock bolt 33 cannot move in the channel 32 from the locking position (see FIG. 3) to the unlocking position (see FIG. 4) because the stop pin 48 is positioned in the stop pin-receiving notch 50 of the lock bolt 33. In order to move the bolt works 168 from the door latched position to a door unlatched position whereat the door-latching rods 174 are removed from the rod-receiving cavities 176, the lock device 10 must be activated to energize the solenoid 52. This is accomplished by, for example, inputing a correct code into the coded electrical signal output device 58 which then energizes the solenoid 52. The energized solenoid 52 pulls the stop pin 48 out of the stop pin-receiving notch 50 of the lock bolt 33 which frees the lock bolt 33 for sliding movement in the channel 32 against the biasing force of the spring 38. Then, when the bolt works 168 is moved by the handle 72 from the door latched position to the door unlatched position, the bolt lock abutment surface 180 of the bolt-receiving notch 178 in the lock bolt engagement mechanism 170 is forced or pushed against the abutment face 34 of the lock bolt 33. The bolt abutment face 34 functions in the manner of a cam surface providing a force component longitudinally of the lock bolt 33 pushing or forcing the lock bolt 33 into the housing 24 to the retracted position (see FIG. 4) against the biasing force of the spring 38 and out of contact with the bolt lock abutment surface 180 of the bolt-receiving notch 178 thereby allowing the horizontal bar 170 of the bolt works 168 to move from door latched position to the door unlatched position pulling the door latching rods 174 out of the rod-receiving cavities 176 unlatching the safe door 62.

It can be readily seen from the above discussions regarding the safe 60 of FIGS. 9 and 10 that the lock device 10 of the present invention provides a bolt 33 orientation and configuration which allows self-activated from the projecting or locking position of FIG. 3 to the retracted or unlocking position of FIG. 4, that is, bolt 33 is moved from the locking position to the unlocking position by coaction with a door latch mechanism. Therefore, the lock device 10 does not require internal actuators or mechanisms to move the bolt between the locking and unlocking positions.

Also, shown in FIGS. 9 and 10, it is clear that, due to the symmetry of the bolt-receiving aperture 30, the same lock device 10 of the present invention can be used for both left-hand and right-hand installations.

The foregoing detailed description is given primarily for clearness of understanding and no unnecessary limitiations are to be understood therefrom for modifications will become obvious to those skilled in the art upon reading this disclosure and may be made without departing from the spirit of the invention and scope of the appended claims.

I claim:

1. A door lock device for selectively locking and unlocking a door, the door lock device comprising:

a door latch mechanism, a casing and an elongate lock bolt;

the door latch mechanism including a lock bolt abutment surface;

a casing having a lock bolt receiving channel with a lock bolt receiving aperture slidably receiving the lock bolt in the channel and further comprising biasing means for resiliently biasing the lock bolt in the channel toward the bolt-receiving aperture, the channel having a closed end with the biasing means being captured between the closed end and the lock bolt, the casing to be attached to a door with the bolt-receiving aperture facing the door latch mechanism;

the lock bolt having a projecting end with an abutment face at the projecting end thereof at an acute angle to the longitudinal axis of the lock bolt;

first bolt stop means cooperating with the abutment face of the lock bolt to limit sliding movement of the lock bolt toward the bolt-receiving aperture so that the lock bolt projects through the bolt-receiving aperture a predetermined distance defining a locking position of the lock bolt, the first bolt stop means comprises a shelf extending between one edge of the bolt-receiving aperture and one longitudinal side of the lock bolt-receiving channel; and second bolt stop means selectively cooperating with the lock bolt when the lock bolt is in the locking position to prevent sliding movement of the lock bolt to an unlocking position, the second bolt stop means further comprising means defining a notch in the lock bolt, a pin movable into and out of the notch, and means for selectively moving the pin into and out of the notch;

the lock bolt slidably mounted within the casing for movement at an acute angle relative to the bolt abutment surface of the door latch mechanism between a locking position whereat the projecting end of the lock bolt projects through the bolt-receiving aperture and into abutting relationship with the bolt abutment surface of the door latch mechanism, and an unlocking position whereat the lock bolt is retracted into the casing, the lock bolt being responsive to abutment by the lock bolt abutment surface of the door latch mechanism to retract into the casing.

2. The door lock device of claim 1, wherein:

The pin-moving means comprises biasing means for biasing the pin into the notch.

3. The door lock device of claim 2, wherein:

the pin-moving means comprises actuator means for retracting the pin out of the notch against the biasing force of the biasing means of the second stop means.

4. A door lock device for selectively locking and unlocking a door, the door lock device comprising:

a door latch mechanism, a casing and an elongated lock bolt;

the door latch mechanism having a bolt abutment surface;

the casing comprising a first side wall a second side wall parallel to and spaced from the first side wall, a front end wall perpendicular to and extending between the first and second side walls and a bolt-receiving aperture is formed in the front end wall substantially laterally centered between the first and second side walls, the casing to be attached to a door with the bolt-receiving aperture facing the bolt abutment surface of the door latch mechanism; and, the elongated lock bolt slidably mounted within the casing for movement at an acute angle relative to the bolt abutment surface of the door latch mechanism between a locking position whereat the lock bolt has a projecting end which projects through the bolt-receiving aperture and into abutting relationship with the bolt abutment surface of the door latch mechanism, and an unlocking position whereat the lock bolt is retracted into the casing, the lock bolt being responsive to abutment by the lock bolt abutment surface of the door latch mechanism to retract into the casing.

5. The door lock device of claim 1 wherein the casing comprises:

a first side wall;

a second side wall parallel to and spaced from the first side wall;

a front end wall extending between the first and second side walls; and, the bolt-receiving aperture is formed in the front end wall substantially laterally centered between the first and second side walls.

6. The door lock device of claim 5, further comprising:

means defining a lock bolt-receiving channel in the casing in open communication at one end with the bolt-receiving aperture of the casing front end wall slidably receiving the lock bolt, the longitudinal axis of the bolt-receiving channel extending into the casing from the bolt-receiving aperture at an acute angle to the front end wall; and, the lock bolt comprises an abutment face at the projecting end thereof adjacent the bolt-receiving aperture, the abutment surface being disposed at an acute angle to the longitudinal axis of the channel substantially equal to the acute angle of the longitudinal axis of the channel relative to the casing front wall.

7. The door lock device of claim 6, wherein the abutment surface of the lock bolt is perpendicular to the front end wall of the casing.

* * * * *